US005379052A

United States Patent [19]

Walck et al.

[11] Patent Number: 5,379,052

[45] Date of Patent: Jan. 3, 1995

[54] VGA AND EGA VIDEO CONTROLLER APPARATUS USING SHARED COMMON VIDEO MEMORY

[75] Inventors: Jeffrey A. Walck, Lebanon, N.J.; Christopher D. Coley, Elsmere, Del.; Donald W. Kugler, Jr., Frenchtown, N.J.

[73] Assignee: Unisys Corporation, Blue Bell, Pa.

[21] Appl. No.: 858,243

[22] Filed: Mar. 26, 1992

[51] Int. Cl.[6] ..... G09G 1/02

[52] U.S. Cl. ..... 345/185; 345/132

[58] Field of Search ..... 340/799, 798, 789, 703, 340/701, 721, 723, 750; 345/185, 200, 201, 202, 203, 132, 112, 212, 213

[56] References Cited

U.S. PATENT DOCUMENTS 4,990,904 2/1991 Zenda ..... 340/799

5,072,411 12/1991 Yamaki ..... 395/162

5,142,676 8/1992 Fried ..... 395/425

5,189,401 2/1993 Kugler, Jr. et al. .

*Primary Examiner*—Ulysses Weldon

*Assistant Examiner*—Xiao M. Wu

*Attorney, Agent, or Firm*—Albert B. Cooper; Mark T. Starr

[57] ABSTRACT

A video controller board for supporting AX Japanese modes and enhanced VGA modes. The board includes two EGA video controllers to support the AX standard and a VGA video controller to support the enhanced VGA standard. Video memory sufficient to support the AX standard is shared by the VGA and EGA controllers. An interface renders the diverse protocols of the VGA and EGA controllers compatible with the shared memory so that each controller sees the memory in a configuration in accordance with its own protocol.

30 Claims, 12 Drawing Sheets

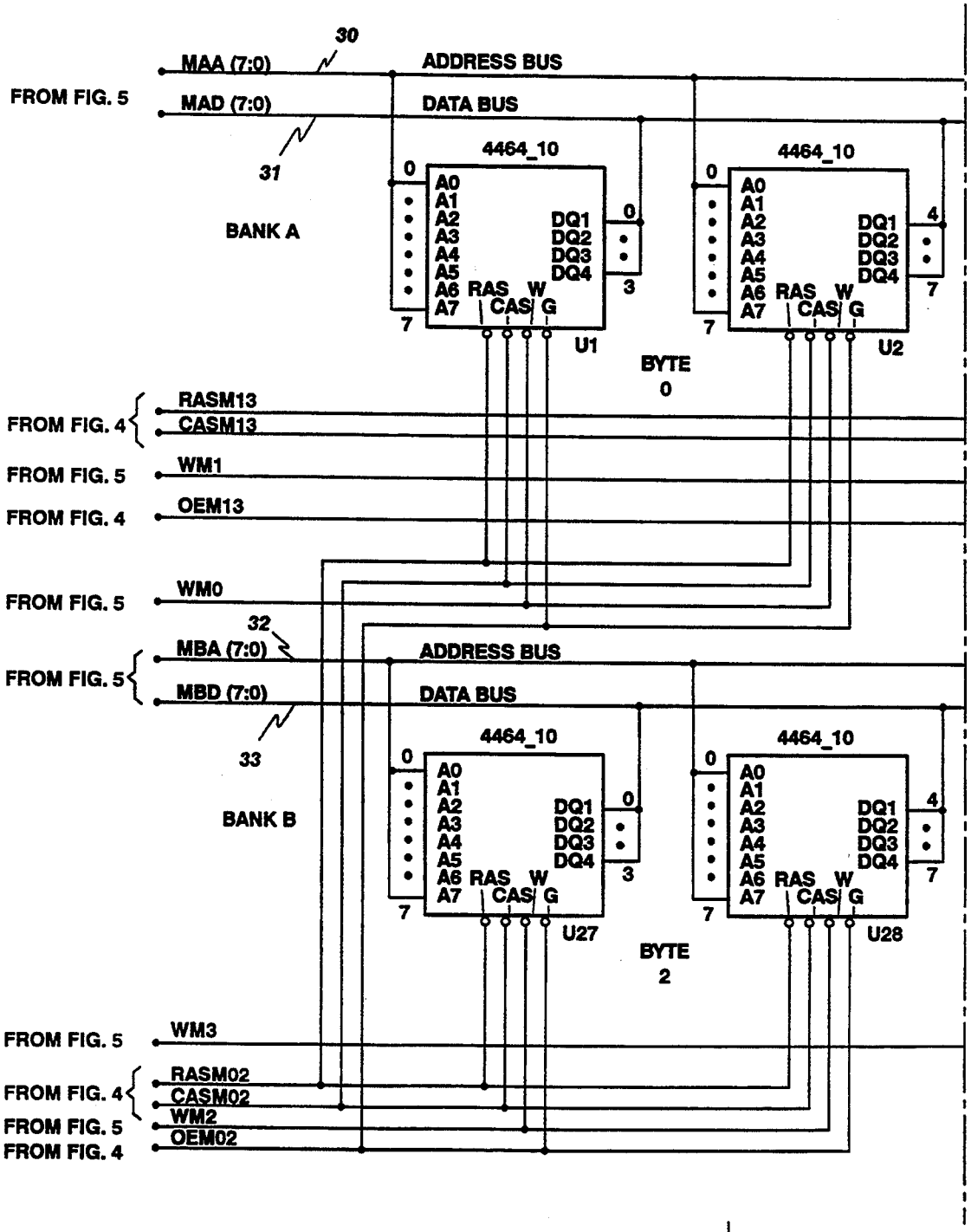
*Figure 2(A)*
*Master Bank*
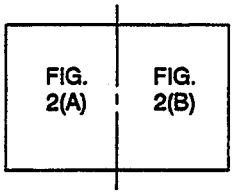

Master Bank

SLAVE BANK

SLAVE BANK

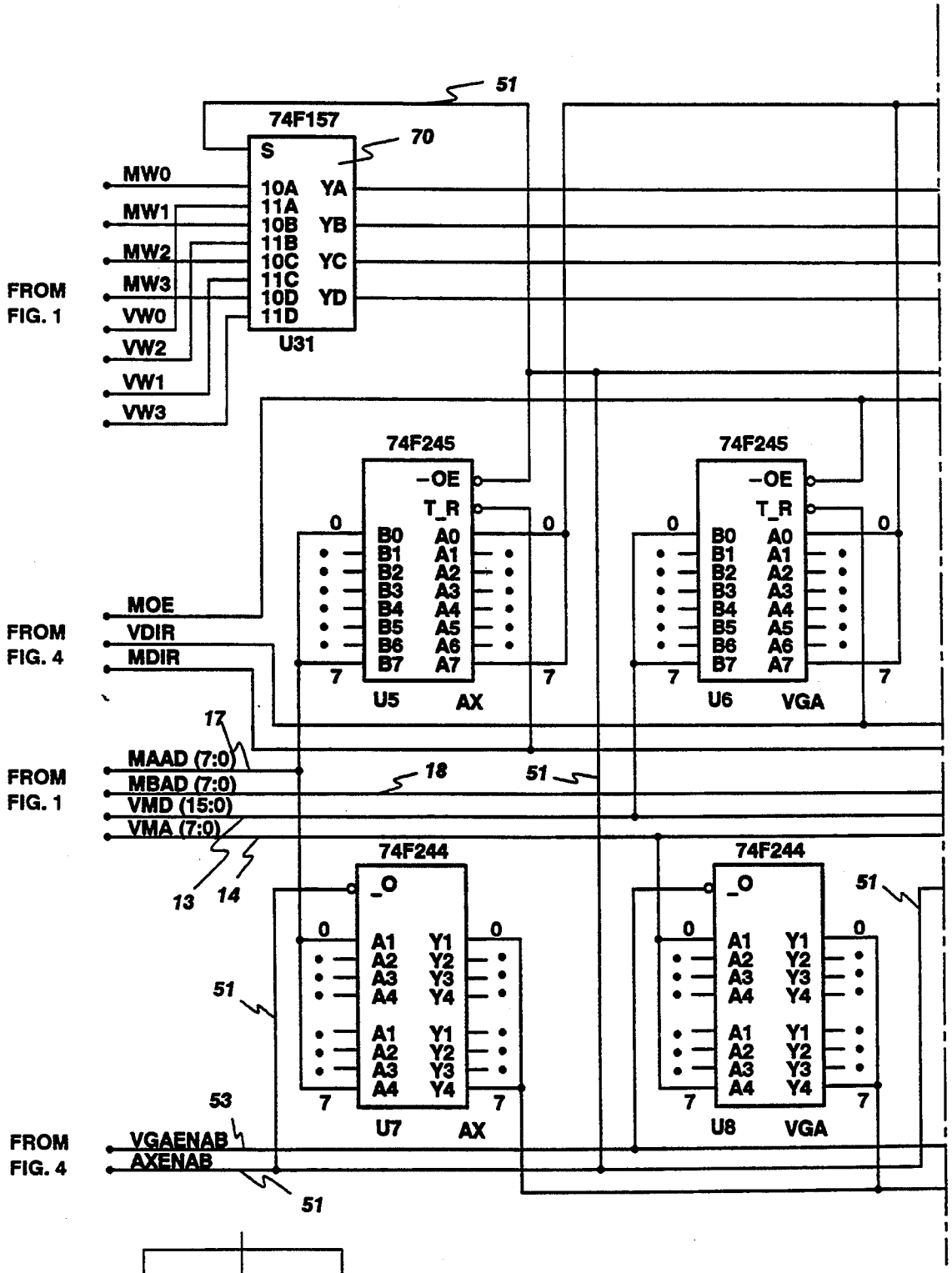
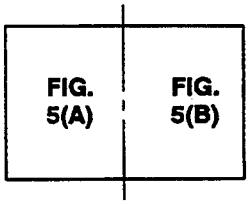
*Figure 5(A) Master Bank Control*

Master Bank
Control

Master Bank
Control

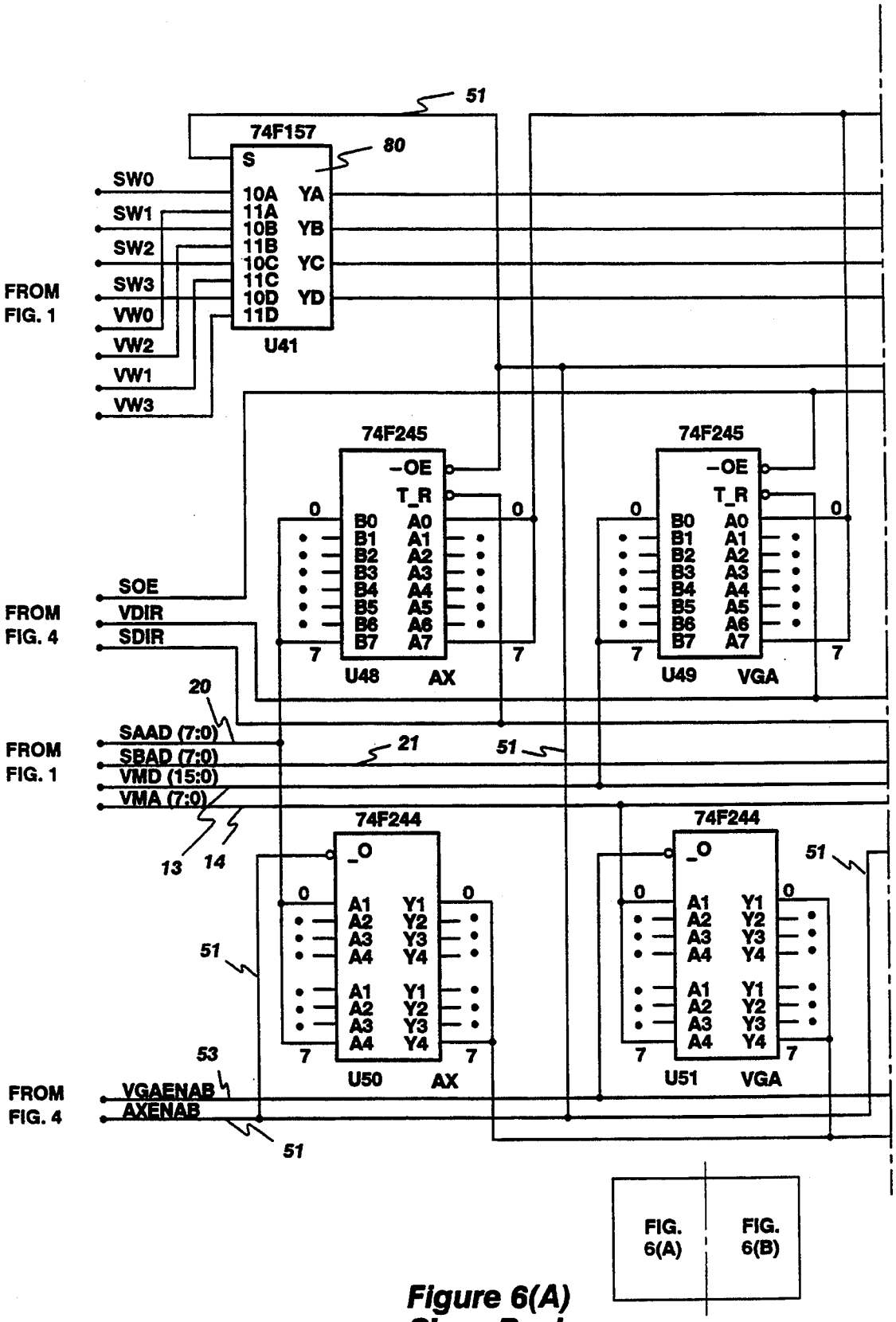
Figure 6(A) Slave Bank Control

*Slave Bank*
*Control*

VGA AND EGA VIDEO CONTROLLER APPARATUS USING SHARED COMMON VIDEO MEMORY

CROSS-REFERENCE TO RELATED APPLICATION

U.S. patent application Ser. No. 07/715,207; filed Jun. 14, 1991; entitled "AX And EGA Video Display Apparatus Utilizing A VGA Monitor"; by the present inventors and assigned to the present assignee discloses a system in which the present invention is advantageously utilized. Said Ser. No. 07/715,207 is incorporated herein by reference in its entirety.

BACKGROUND OF THE INVENTION

1. Field Of the Invention

The invention relates to the video controller of the personal computer and workstation technology, particularly with respect to a video controller for supporting both VGA and EGA operating modes, and more specifically, the Architecture Extended (AX) Japanese EGA (JEGA) mode.

2. Description of the Prior Art

Three different architectures are presently utilized for the implementation of video controllers; viz., the VGA and enhanced VGA standard, the EGA standard and the Architecture Extended (AX) standard. The AX standard was developed for controlling the display of Japanese characters and utilizes two EGA video controllers operating substantially independently with respect to each other. The standard VGA video controller, as well as the standard EGA video controller, requires 256 kilobytes (KB) of video memory whereas extended VGA requires 512 KB of video memory. The AX standard requires two independent video memory banks of 256 KB each for the two EGA video controllers, respectively, utilized to implement the standard. The EGA convention supports a resolution of 640×350 pixels with 16 colors from a palette of 64 while standard VGA supports 256 simultaneous colors from a palette of 256 K (262,144) colors with resolution formats ranging to 640×480 pixels. Extended VGA supports resolution formats of 800×600 pixels and 1024×768 pixels, in some instances with 256 simultaneous colors.

The video memory is utilized by the controller for such functions as storing and manipulating character codes and character fonts and for providing multiple graphic frame buffers. The enhanced VGA architecture utilizes the full 512 KB of video memory primarily in generating high resolution graphics over a wide range of simultaneous colors. Typically, video memory is implemented utilizing Dynamic Random Access Memory chips (DRAM). In a well known manner, such DRAM elements utilize row and column addressing with the row and column addresses sequentially strobed into the memory chips by Row Address Strobes (RAS) and Column Address Strobes (CAS). Data is written to the memory by a Write Enable (WE) signal and read from the memory by an Output Enable (OE) signal.

The EGA video controller memory architecture, interface and bus protocol are significantly different from that of the VGA video controller. The EGA controller provides two independent eight-bit memory buses coupled to separate memory banks of 128 KB each. The buses carry time multiplexed address and data signals. The EGA controller applies the RAS and CAS signals to the full 256 KB of memory and applies the OE read signals transverse to the memory banks in a direction perpendicular to the direction of the buses. Any byte can be read from either bank by appropriate energization of the buses and OE lines. The EGA controller utilizes separate WE lines to write access any byte of the memory.

The VGA controller, on the other hand, utilizes separate address and data buses, the address bus being eight bits wide (with a ninth bit for the enhanced VGA capabilities) and the data bus sixteen bits wide. The address and data buses are connected to the full 256 KB of memory with individual RAS and CAS lines connected to strobe separate 128 KB memory banks. Separate OE lines run in the same direction through the memory as the RAS and CAS lines and during a memory read, two bytes are accessed and applied to the sixteen-bit wide data bus. Individual bytes are write accessed by individual WE lines. The ninth address line functions as a bank select between two 256 KB memory banks providing a total of 512 KB of accessable memory.

It is thus appreciated that in the VGA mode, access to the locations of the memory are primarily effected by selective application of the RAS, CAS, OE and WE signals. During a read operation, sixteen bits (two bytes) are accessed. In the EGA mode, on the other hand, memory locations are accessed by application of address signals to the appropriate memory bus and selective application of OE and WE signals. These diverse memory interfaces indicate the use of separate and independent memories for VGA and for EGA.

Thus, in the prior art, video controller boards required a separate memory array for each controller. If a VGA video controller board were required, 256 KB of video memory would be utilized for standard VGA or 512 KB of video memory would be utilized for enhanced or extended VGA modes. If an EGA video controller board were desired, 256 KB of video memory would be utilized for each EGA controller. If an AX compatible board is desired, two EGA video controllers are utilized with two independent banks of 256 KB of video memory for a total of 512 KB of video memory.

If it is desired to construct a video controller board that supports both AX/EGA and enhanced VGA modes, the two EGA controllers for the AX modes would require two respective dedicated banks of 256 KB of video memory each while the enhanced VGA controller would require an additional 512 KB of video memory for a total board memory requirement of 1024 KB or one megabyte of video memory. It is appreciated that DRAM memory chips are very expensive, thus significantly increasing the cost of such combination systems.

The apparatus of said Ser. No. 07/715,207 embodies the AX standard and enhanced VGA utilizing two diverse video controller memory architectures, that of the Chips And Technologies (C+T) 435 EGA controller and the Western Digital (WD) PVGA1B VGA controller. The AX Japanese video standard implemented by the system of said Ser. No. 07/715,207 utilizes two C+T 435 EGA controllers requiring independent memory banks of 256 KB each. The WDPVGA1B VGA controller requires 512 KB of video memory. Thus, conventional design approaches indicate, for the reasons given above, that two independent memory arrays of 512 KB each would be required for the two entirely different video circuits that utilize different and incompatible video controller memory architectures, memory interfaces, bus protocols and bus structures. A total of one megabyte of expensive video memory would normally be utilized to satisfy the requirements of this design.

SUMMARY OF THE INVENTION

It is a desideratum of the present invention to utilize the same video memory to support both the VGA and EGA modes thereby reducing the amount of required memory by one-half. Specifically, with respect to the system described above, it is desirable to utilize one-half megabyte of video memory to support the VGA controller with extended and enhanced capabilities, as well as the Japanese AX standard utilizing two EGA controllers.

The above objectives of the present invention are achieved by video controller apparatus having a video memory. First video controller means of a first type provides address and control signals to the video memory and writes data to, and reads data from, the video memory in accordance with a first memory interface protocol, the first video controller means operating in accordance with a first video mode and requiring a first video memory size. Second video controller means of a second type provides address and control signals to the video memory and writes data to, and reads data from, the video memory in accordance with a second memory interface protocol, the second video controller means operating in accordance with a second video mode and requiring a second video memory size, the video memory being no larger than the first or second video memory size. The video controller apparatus receives a mode enabling signal for selectively enabling the first or second video mode. First gated buffers couple the address and data signals between the first video controller means and the video memory in accordance with the first memory interface protocol when the mode enabling signal is enabling the first video mode. Second gated buffers couple the address and data signals between the second video controller means and the video memory in accordance with the second memory interface protocol when the mode enabling signal is enabling the second video mode. Multiplexers selectively couple either the control signals from the first video controller means to the video memory in accordance with the first memory interface protocol when the mode enabling signal is enabling the first video mode or the control signals from the second video controller means to the video memory in accordance with the second memory interface protocol when the mode enabling signal is enabling the second video mode.

In the preferred embodiment of the invention, the first video mode is VGA and the second video mode is EGA. Specifically, the first video mode is enhanced VGA and the second video mode is Japanese AX/EGA with the second video controller means comprising two EGA video controllers. In the preferred embodiment, the video memory is comprised of DRAM utilizing RAS, CAS, OE and WE control signals. The memory is arranged in four banks of 128 KB each with a separate eight-bit wide address bus and eight-bit wide data bus interconnecting the memory chips of each bank. Four sets of RAS, CAS and OE lines interconnect byte groups of the memory in a direction orthogonal to the address and data buses. Each set of RAS, CAS and OE lines connect to corresponding byte groups of adjacent memory banks. A separate WE line is brought out for each byte group of the memory.

In the preferred embodiment, the first video controller means comprises an enhanced VGA controller with a sixteen-bit wide data bus and an eight-bit wide address bus with an additional address bit to distinguish between 256 KB memory banks. The VGA controller provides RAS and CAS signals for selectively strobing 128 KB banks of the memory and provides OE signals for application in the same direction as the RAS and CAS signals to selectively read sixteen bits (two bytes) from the 128 KB banks. Each EGA controller provides separate eight-bit wide time-multiplexed address and data buses for application to 128 KB memory banks, respectively, and RAS and CAS signals for application to the entire 256 KB memory. The EGA controller provides OE signals for application through the memory in a direction orthogonal to the address and data buses.

The gated buffers are arranged to split each time division multiplexed EGA address and data bus into separate address and data buses for application to the respective address and data buses of the memory and to split the sixteen-bit wide VGA data bus into separate eight-bit wide data buses for application to the data buses of the memory. The gated buffers are further arranged to apply the eight-bit wide VGA address bus to all of the address buses of the memory. The multiplexers are arranged to apply the RAS, CAS and OE signals through the memory in a direction orthogonal to the address and data buses by selectively applying the RAS, CAS and OE signals from the controllers to the four sets of RAS, CAS and OE lines interconnecting byte groups of the memory. The EGA RAS and CAS signals from each EGA controller are applied throughout the entire associated 256 KB memory bank while the VGA RAS and CAS signals are applied in conjunction with the VGA OE signals through appropriate 128 KB portions of the memory.

BRIEF DESCRIPTION OF THE DRAWINGS

FIG. 4 provides RAS, CAS and OE signals to the master and slave memory banks of FIGS. 2 and 3 as well as direction and control signals to the circuitry of FIGS. 5 and 6. FIG. 5 provides address, data and WE signals to the master memory bank of FIG. 2. FIG. 6 provides address, data and WE signals to the slave memory bank of FIG. 3.

DESCRIPTION OF THE PREFERRED EMBODIMENT

Figure 1A:
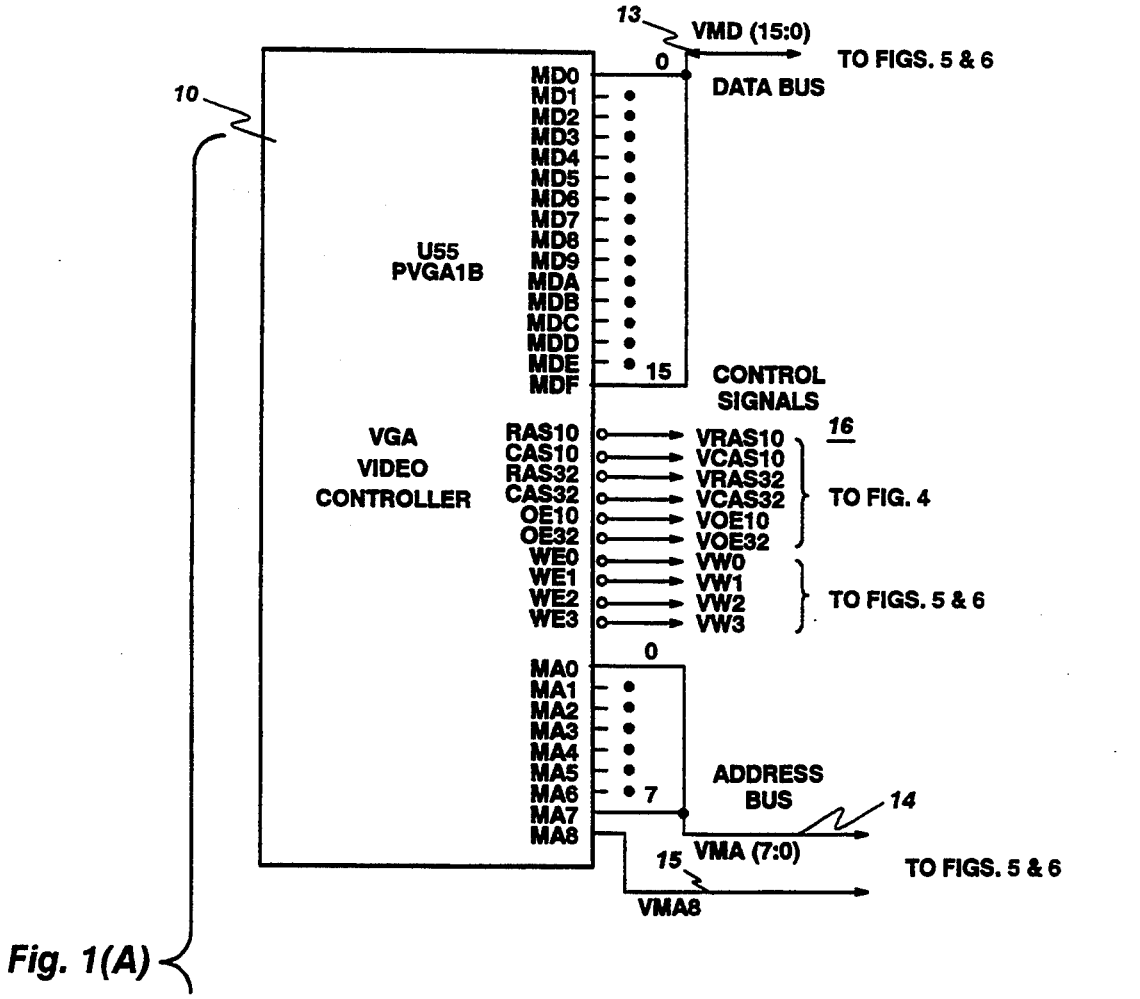
FIG. 1 is a schematic diagram illustrating the VGA and EGA video controller chips utilized in implementing the video controller of the present invention.
Figure 1A:
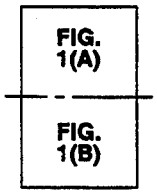
Figure 1B:
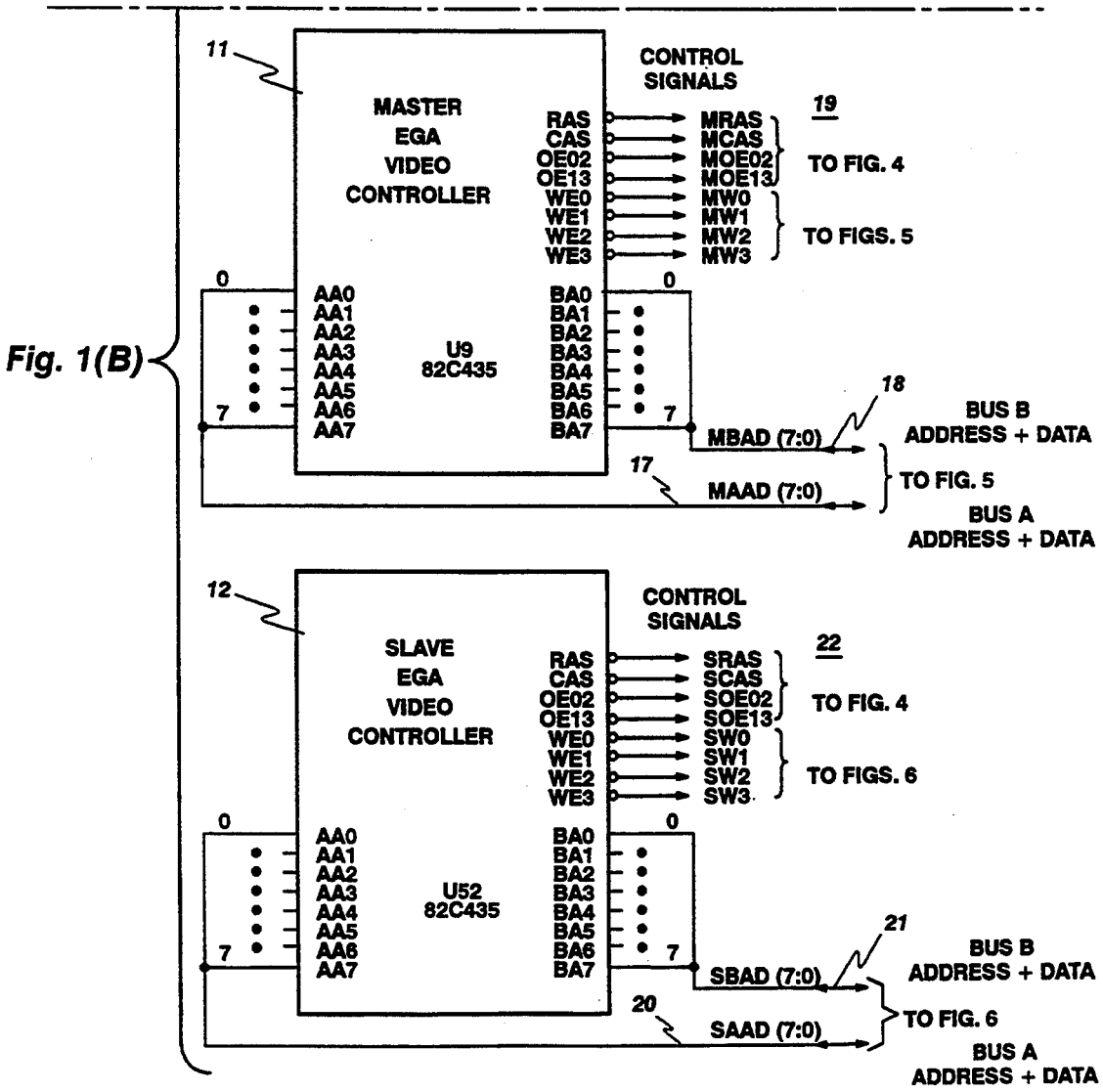

Referring to FIG. 1, the three video controllers of the system of said Ser. No. 07/715,207 are illustrated. A VGA video controller 10 is utilized in implementing an enhanced VGA mode of operation while a master EGA video controller 11 and a slave EGA video controller 12 are utilized to implement the Japanese AX standard. The VGA controller 10 is the VGA controller 20 and the EGA controllers 11 and 12 are the EGA controllers 40 of said Ser. No. 07/715,207. In the preferred embodiment, the VGA video controller 10 is implemented by a Western Digital PVGA1B controller and the EGA controllers 11 and 12 by C+T 82C435 controllers. As discussed above, the VGA controller 10 requires 512 KB of video memory, while each of the VGA controllers 11 and 12 requires 256 KB of video memory.

The VGA controller 10 generates a bus 13 denoted as VMD(15:0). The bus 13 is sixteen bits wide and is the hi-directional memory data bus for coupling the video controller 10 to its video memory array for transferring data therebetween. The sixteen lines of the bus 13 are denoted as (15:0) and are generated from the sixteen controller Memory Data outputs MD0, MD1, . . . , MDF (hexadecimal). It is appreciated that the nomenclature VMD associated with the bus 13 denotes VGA Memory Data bus.

The VGA video controller 10 also generates an eight-bit wide address bus 14 denoted as VMA(7:0). The bus 14 is the memory address bus for transferring memory addresses from the controller 10 to its video memory for effecting read and write memory accesses therein. The eight lines of the bus 14 are generated by the video controller Memory Address outputs MA0, MA1, . . . , MA7. The bus name VMA denotes VGA Memory Address bus. The VGA video controller 10 also generates a separate address signal on a line 15 denoted as VMA8. VMA8 is generated from the MA8 output of the VGA video controller 10 and is separate from the bus 14.

The VGA video controller 10 also generates control signals 16 for controlling its video memory which, as described above, is a DRAM array. The control signals 16 are denoted as VRAS10, VCAS10, VRAS32, VCAS32, VOE10, VOE32, VW0, VW1, VW2 and VW3 generated from respective controller outputs RAS10, CAS10, RAS32, CAS32, OE10, OE32, WE0, WE1, WE2 and WE3.

As is known in the technology, the RAS and CAS signals are the DRAM Row Address Strobe and Column Address Strobe, respectively, for strobing the row and column address signals on the address bus 14 into the memory. In order to address a memory location, the video controller 10 places a row address on the bus 14 and issues a RAS signal. The video controller 10 then places a column address on the bus 14 and issues a CAS signal. In the DRAM technology, the row and column access locations to the video memory are time multiplexed on the bus 14. The OE signals are the Output Enable signals for the memory read operations controlling the memory to output data to the data bus 13. The WE signals are the Write Enable signals for writing data from the data bus 13 into the video memory array.

The master EGA video controller 11 generates separate eight-bit wide multiplexed address and data buses 17 and 18. The bus 17 (bus A) is denoted as MAAD(7:0) and the bus 18 (bus B) is denoted as MBAD(7:0). The eight lines of bus A are generated by controller outputs AA0, AA1, . . . , AA7, respectively. The eight lines of bus B are generated by controller outputs BA0, BA1, . . . , BA7, respectively. The buses 17 and 18 contain time multiplexed address and data for respective banks of the video memory for EGA controller 11. Each bus 17 and 18 conveys eight bits of row address, eight bits of column address and eight bits of data in time multiplexed fashion.

The master EGA video controller 11 provides control signals 19 to control its video memory. These control signals are denoted as MRAS, MCAS, MOE02, MOE13, MW0, MW1, MW2 and MW3, the "M" denoting master. These signals are generated by controller outputs RAS, CAS, OE02, 0E13, WE0, WE1, WE2 and WE3, respectively. The RAS and CAS signals are the row address and column address strobes for the DRAM memory, the OE signals are the output enables to gate data from the memory onto the A and B buses and the WE signals are the write enables to write data into the memory from the A and B buses.

The slave EGA video controller 12 is identical to the controller 11 except that it performs the slave function in the master-slave configuration of the AX architecture. As indicated by reference numerals 20 and 21, the video controller 12 generates the A and B buses in the manner described above with respect to the video controller 11. The A and B buses from the video controller 12 are, however, denoted as SAAD(7:0) and SBAD(7:0), respectively. Additionally, in the manner described above with respect to the video controller 11, the video controller 12 generates memory control signals 22 denoted as SRAS, SCAS, SOE02, SOE13, SW0, SW1, SW2 and SW3, the initial letter "S" denoting slave.

With respect to the controller bus naming nomenclature, an initial letter "V" denotes a bus connected to the VGA video controller 10, an initial letter "M" denotes a bus connected to the master EGA video controller 11 and an initial letter "S" denotes a bus connected to the slave EGA video controller 12. With respect to the EGA controllers, the second letter identifies either the bus A or the bus B. The last two letters AD denote that the bus is a multiplexed address and data bus and the numbers in parentheses reference the actual signal lines. The above described bus naming convention applies to the buses originating at the video controllers. A somewhat different convention is utilized with respect to the memory buses to be described. With respect to the control signals, the numerals refer to memory bytes in a manner to be explained.

Figure 2B:
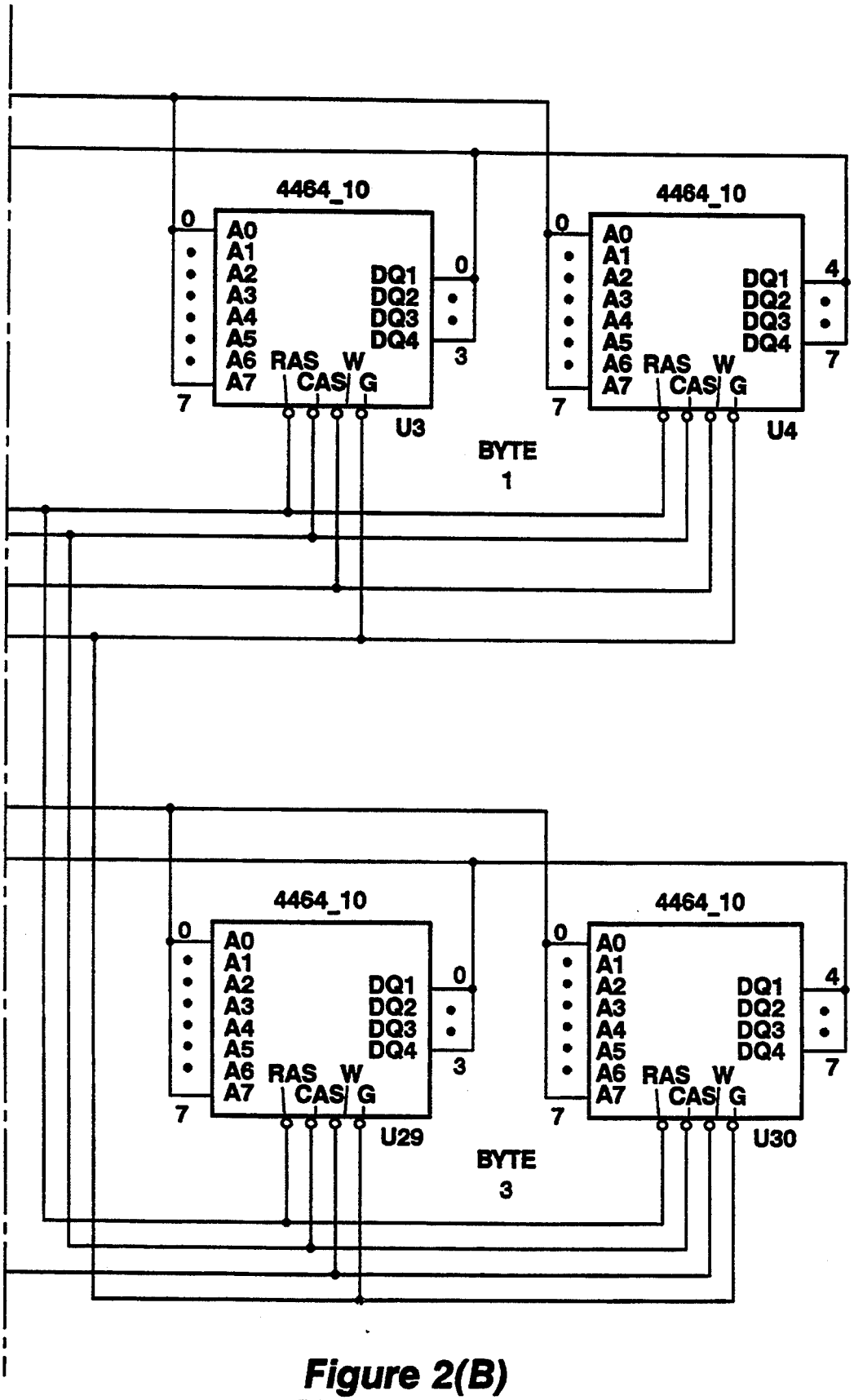
FIG. 2 is a schematic block diagram of the master memory bank of the video memory utilized in implementing the video controller of the present invention. Buses and control signals interconnect the memory chips of the master memory bank in a manner in accordance with the invention.
Figure 3A:
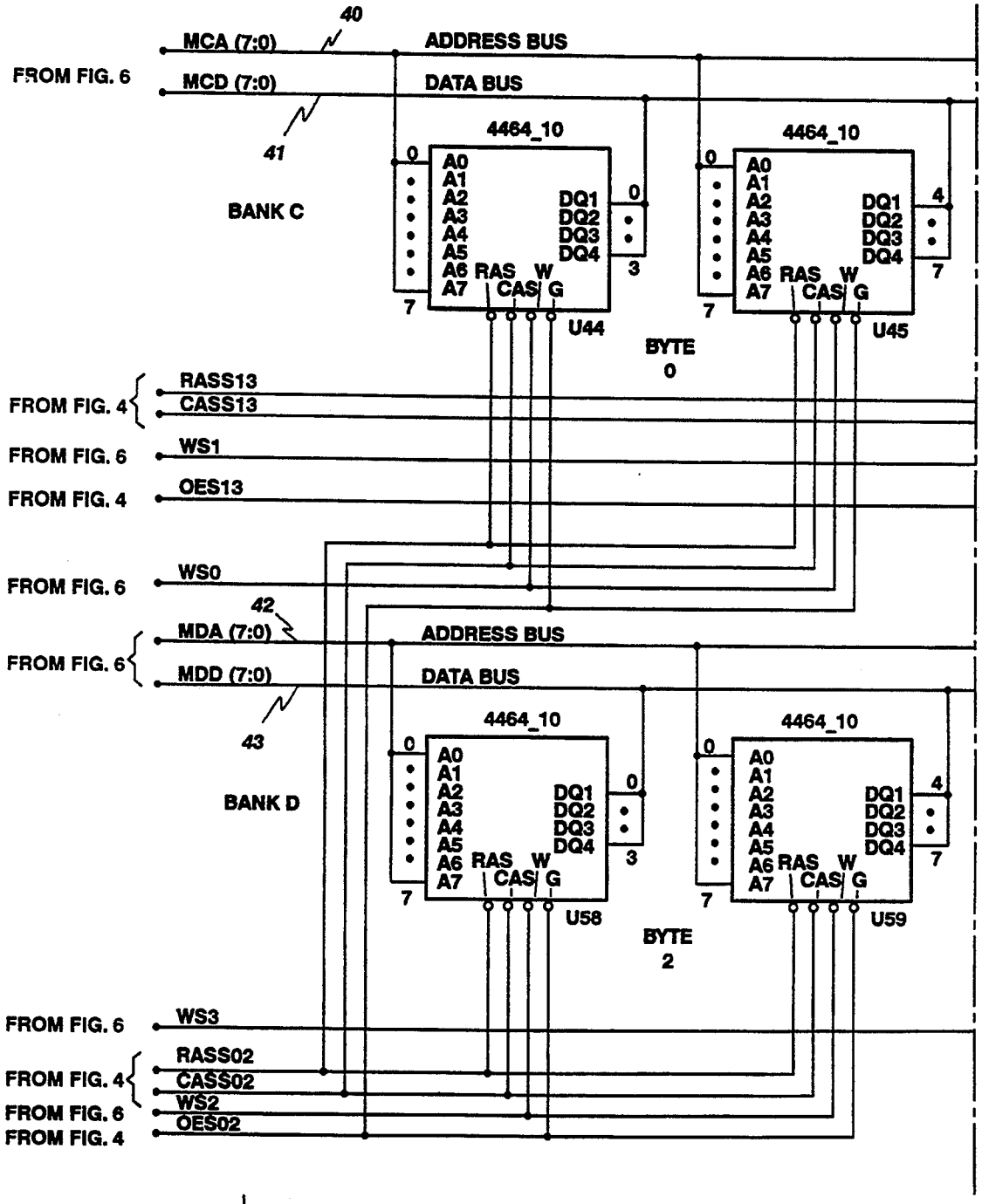
FIG. 3 is a schematic block diagram of the slave memory bank of the video memory utilized in implementing the video controller of the present invention. Buses and control signals interconnect the memory chips of the slave memory bank in a manner in accordance with the invention.
Figure 3A:
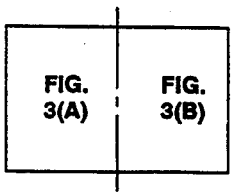
Figure 3B:
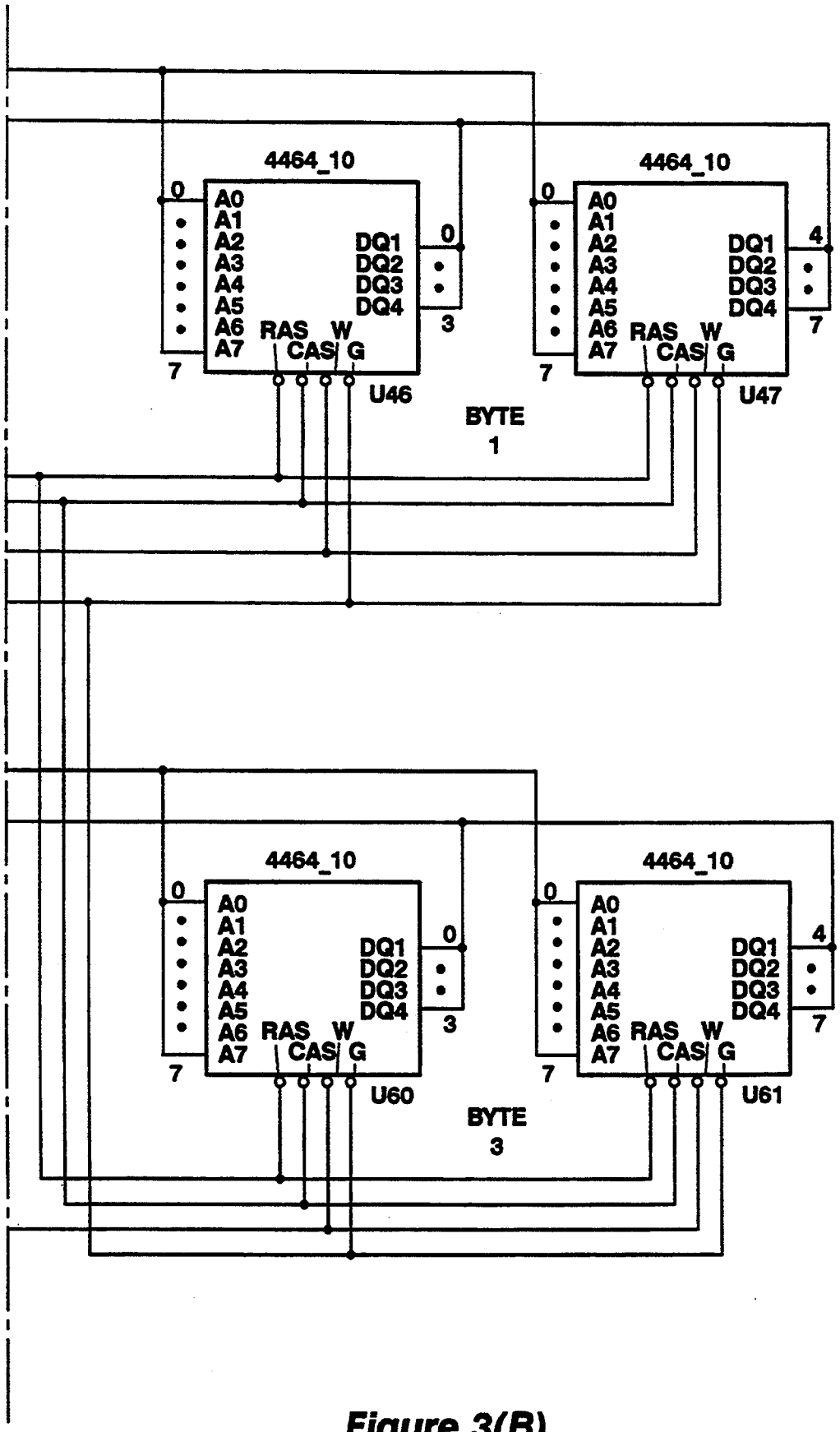

Referring to FIGS. 2 and 3, a master bank of video memory and a slave bank of video memory, respectively, are depicted. The master bank of video memory is utilized by the master EGA video controller 11 and the slave bank of video memory is utilized by the slave EGA video controller 12 when the system is operating in the AX mode. Both the master and slave banks of memory are utilized by the VGA video controller 10 when the system is operating in the VGA mode.

Each memory bank is comprised of 4464_10 DRAM chips. The DRAM chips of FIG. 2 are denoted as U1–U4 and U27–U30. The DRAM chips of FIG. 3 are denoted as U44–U47 and U58–U61. Each DRAM chip contains 64 K locations and each location contains a nibble of four bits of data. Thus, the master bank and slave bank each contains 256 KB of video memory with each byte containing eight bits. Each memory chip includes an eight-bit address input port A0, A1, . . . , A7 and a four-bit data port DQ1, DQ2, DQ3 and DQ4. The control inputs to each chip are RAS, CAS, W and G. RAS and CAS are the row address and column address strobe control inputs, W is the write enable control input for writing data from the data port DQ1–DQ4 into an accessed location, and G is the output enable Gate control for reading data from an accessed location to the chip data port DQ1–DQ4.

In order to access a chip location, eight bits of row address are applied to the address input port A0–A7 and the RAS input is strobed. The RAS signal latches the row address internally in the chip. Next, an eight-bit column address is applied to the address input port A0–A7 and the CAS input is strobed latching the column address internally in the chip. In order to write data into the one out of 64 K nibbles accessed by the row and column address, the data is applied to the data port DQ1–DQ4 and the W input is strobed. If it is desired to read the data stored at the accessed nibble, the G input is strobed and the data is passed to the data port DQ1–DQ4.

Before describing the memory bus architecture and memory interface in accordance with the invention, the use of the memory chips illustrated in FIGS. 2 and 3 with the video controllers of FIG. 1 in accordance with the prior art, will now be described for contrast. With reference to FIGS. 1, 2 and 3, a byte 0 is formed from the nibbles of chips U1 and U2 of FIG. 2 and from the nibbles of chips U44 and U45 of FIG. 3. A byte 1 is formed from the nibbles of chips U3 and U4 of FIG. 2 and from the nibbles of chips U46 and U47 of FIG. 3. A byte 2 is formed from the nibbles of chips U27 and U28 of FIG. 2 and from the nibbles of chips U58 and U59 of FIG. 3. A byte 3 is formed from the nibbles of chips U29 and U30 of FIG. 2 and from the nibbles of chips U60 and U61 of FIG. 3.

When, in accordance with the prior art, it is desired to implement an enhanced VGA controller utilizing the WDPVGA1B controller 10 of FIG. 1, the sixteen bits of bytes 1 and 0 and the sixteen bits of bytes 2 and 3 from both FIGS. 2 and 3, are connected in parallel to the sixteen lines of the VGA data bus 13. The eight lines of the address bus 14 are commonly connected to the eight-bit address port of all sixteen chips of FIGS. 2 and 3. The RAS10 control signal is connected to the RAS input of the byte 0 chips and the byte 1 chips on the banks of both FIGS. 2 and 3. Similarly, the RAS32 signal is connected to the chips of FIGS. 2 and 3 that comprise bytes 2 and 3. In a similar manner, the OE10 and OE32 signals are applied to the Gate inputs of the byte 0 and byte 1 chips and the byte 2 and byte 3 chips, respectively, of both FIGS. 2 and 3. The WE0–WE3 signals are applied to the W inputs of the chips of the similarly designated bytes of FIGS. 2 and 3. The CAS10 and CAS32 signals are applied to the CAS inputs of the chips comprising the respectively designated bytes in the manner described with respect to the RAS signals, except that the CAS signals are applied to the memory banks through a multiplexer. The multiplexer directs the CAS signals either to the memory chips of FIG. 2 or the memory chips of FIG. 3, in accordance with the state of the VMA8 signal on the lead 15.

In a prior art EGA environment, the master EGA video controller 11 would be connected to eight memory chips such as those illustrated in FIG. 2 as follows. The data port nibbles from chips U1 and U2 would be concatenated to form byte 0 and the data port nibbles from chips U3 and U4 would be concatenated to form byte 1. In a similar manner, byte 2 would be formed from the data port nibbles of chips U27 and U28 and byte 3 would be formed from the data port nibbles of chips U29 and U30. The eight-bit address ports and eight-bit concatenated data ports from chips U1–U4 would be connected in parallel to the eight-bit multiplexed address and data bus 17 of the EGA video controller 11. In a similar manner, the multiplexed address and data bus 18 of the EGA video controller 11 would be connected to the address and data ports of chips U27–U30. The RAS and CAS control signals from the video controller 11 would be commonly applied to the respective RAS and CAS inputs of all of the chips of the memory depicted in FIG. 2. The OE02 control signal would be commonly applied to the Gate inputs of the chips comprising bytes 0 and 2 while the OE13 control signal would be commonly applied to the Gate inputs of the chips comprising bytes 1 and 3. The WE0–WE3 control signals would be applied, respectively, to the W inputs of the chips comprising the designated bytes. The slave EGA video controller 12 would be connected to the memory chips of FIG. 3 in the manner described with respect to the master controller.

With continued reference to FIG. 2, the memory bus and control signal architecture of the present invention is illustrated. As previously described, the memory array of FIG. 2 is denoted as the "master bank" since it provides the video memory for the master EGA video controller 11 when the system is operating in the AX mode. The memory array of FIG. 2 provides one-half of the video memory requirements of the VGA video controller 10 when the system is operating in an enhanced VGA mode. The master bank of FIG. 2 is comprised of memory banks A and B each containing 128 KB. The chips U1–U4 comprise bank A and the chips U27–U30 comprise bank B. The arrangement of the chips into bytes 0–3, as described above, apply to the present configuration. Thus, bank A includes bytes 0 and 1, and bank B includes bytes 2 and 3. The address ports of the chips of bank A are connected in parallel to an eight-bit address bus 30 denoted as MAA(7:0). The concatenated data ports of the byte 0 chips and the concatenated data ports of the byte 1 chips are connected in parallel to an eight-bit data bus 31 denoted as MAD(7:0). In a similar manner, the chips of bank B are connected to an address bus 32 denoted as MBA(7:0) and to a data bus 33 denoted as MBD(7:0).

In the bus naming convention for the memories, the first letter "M" denotes memory, the second letter denotes the memory bank and the last letter denotes address or data. Thus, MAA denotes the memory bank A address bus and MAD denotes the memory bank A data bus. Similarly, MBA denotes the memory bank B address bus and MBD denotes the memory bank B data bus.

Byte 0 and byte 2 have a common set of RAS, CAS and OE control signal inputs denoted as RASM02, CASM02 and OEM02. In a similar manner, the chips of bytes 1 and 3 receive common control signals RASM13, CASM13 and OEM 13. The W inputs of the chips of each byte receives a separate write enable signal. The WM0, WM1, WM2 and WM3 signals provide write enable control for bytes 0–3, respectively. In the naming convention for the memory control signals, the "M" indicates the master bank and the numerals indicate the bytes with which the control signals are associated.

Thus, the master bank of FIG. 2 is comprised of two banks of 128 KB each of video memory, each bank having its own address and data buses with the RAS, CAS and OE control signals running transversely across the banks orthogonal thereto and orthogonal to the address and data buses. This arrangement provides access, by a video controller, to any byte from the total of 256 KB of the master bank of FIG. 2.

Referring to FIG. 3, the slave bank of 256 KB of video memory is illustrated. The slave bank provides the video memory for the slave EGA controller 12 when the system is operating in the AX mode and is utilized with the master bank of FIG. 2 to fulfill the video memory requirements of the VGA video controller 10 when the system is operating in an enhanced VGA mode. The slave bank of FIG. 3 is configured in a manner identical to that described above with respect to the master bank of FIG. 2.

The slave bank of FIG. 3 is comprised of 128 KB memory banks denoted as bank C and bank D. Bank C includes bytes 0 and 1, and bank D includes bytes 2 and 3. Thus, bank C is comprised of chips U44–U47 and bank D is comprised of chips U58–U61. The address and data buses for bank C are denoted by reference numerals 40 and 41, respectively, and the address and data buses of bank D are denoted by reference numerals 42 and 43, respectively. As described above with respect to FIG. 2, the second letter of the bus names designate either bank C or bank D. With respect to the control signals, the second S in the RAS and CAS signals and the S in the WS and OES signals denote the slave bank of FIG. 3.

As discussed above, the bus and control signal structures and protocols of FIGS. 2 and 3 are implemented in accordance with the invention so that the VGA video controller 10, master EGA video controller 11 and slave EGA video controller 12 of FIG. 1 can share the 512 KB video memory of FIGS. 2 and 3. The circuitry of FIGS. 4–6 conform the outputs of the video controllers of FIG. 1 to the inputs of the memory arrays of FIGS. 2 and 3 so that when the system operates in the VGA mode, the VGA video controller 10 accesses the full 512 KB memory of FIGS. 2 and 3 in the configuration in which it prefers to see the memory. Similarly, when the system operates in the AX mode, the circuitry of FIGS. 4–6 interconnect the video controllers 11 and 12 with the master and slave memory banks of FIGS. 2 and 3, respectively, so that each EGA controller independently accesses its memory in the configuration in which it prefers to see the memory. Thus it is appreciated that the circuitry of FIGS. 4–6, together with the bus and control signal interconnections of FIGS. 2 and 3, provide an interface that conforms the outputs of the video controllers of FIG. 1 with the memory banks of FIGS. 2 and 3 so that the 512 KB of memory illustrated supports both the enhanced VGA and AX video modes.

Figure 4A:
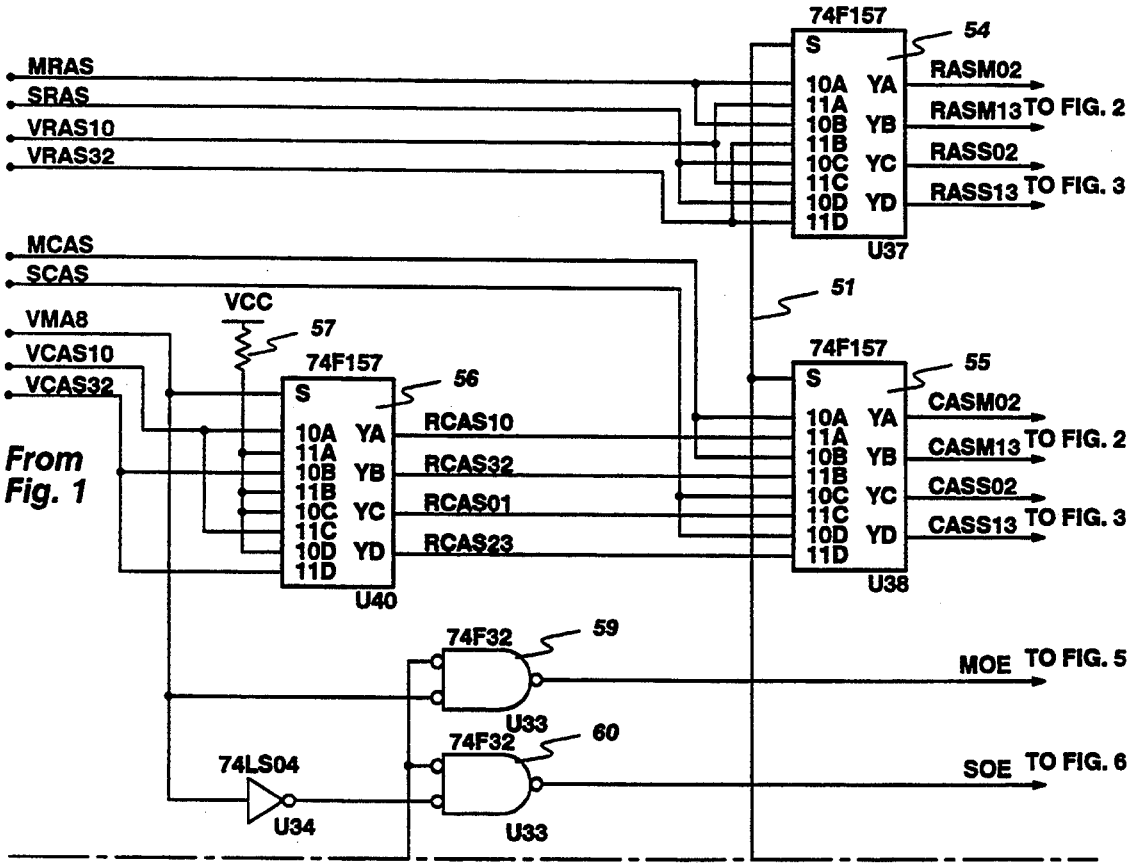
FIGS. 4, 5 and 6 are schematic block diagrams illustrating circuitry for intercoupling the video controllers of FIG. 1 with the video memory banks of FIGS. 2 and 3 in accordance with the invention.
Figure 4A:
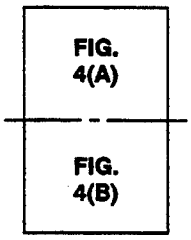
Figure 4B:
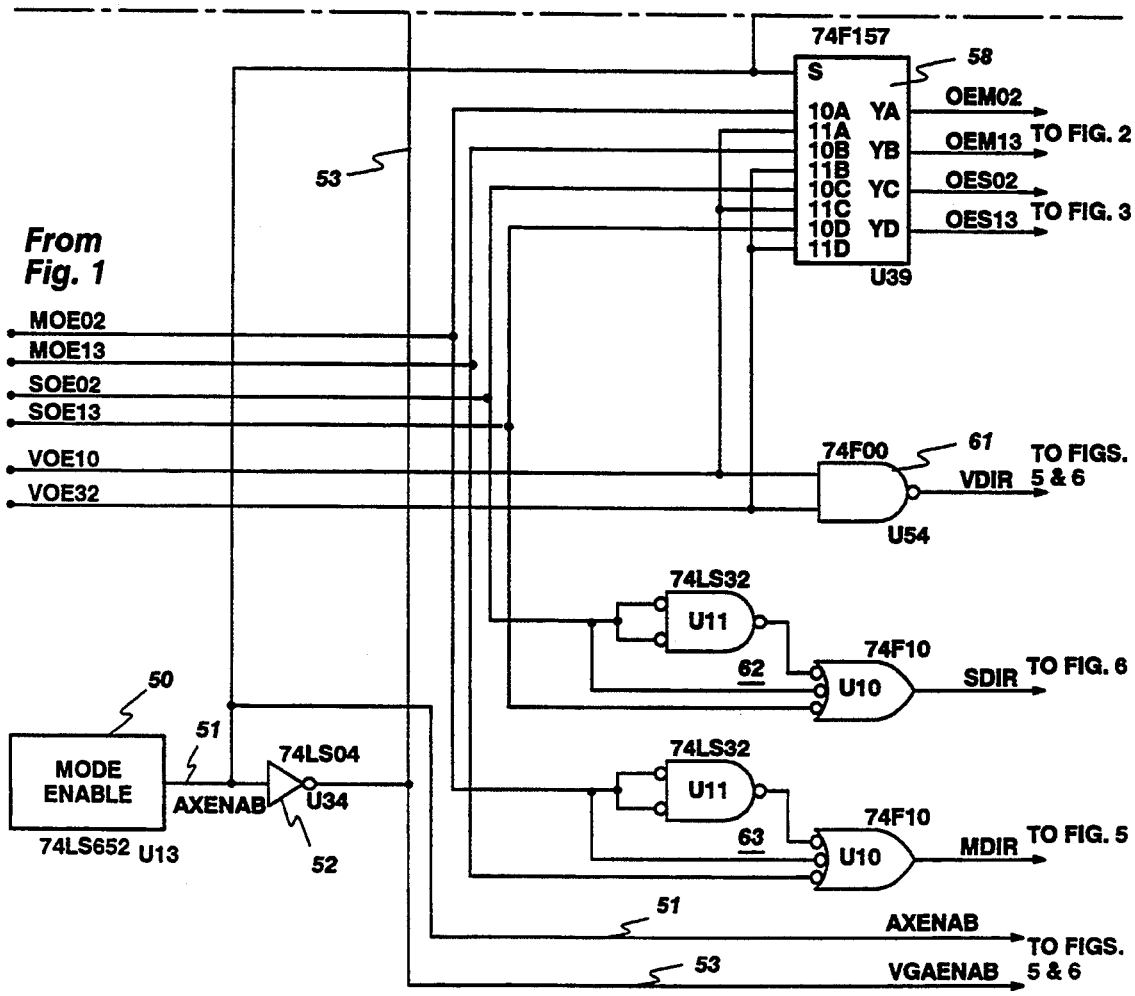
Figures 5, 5B:
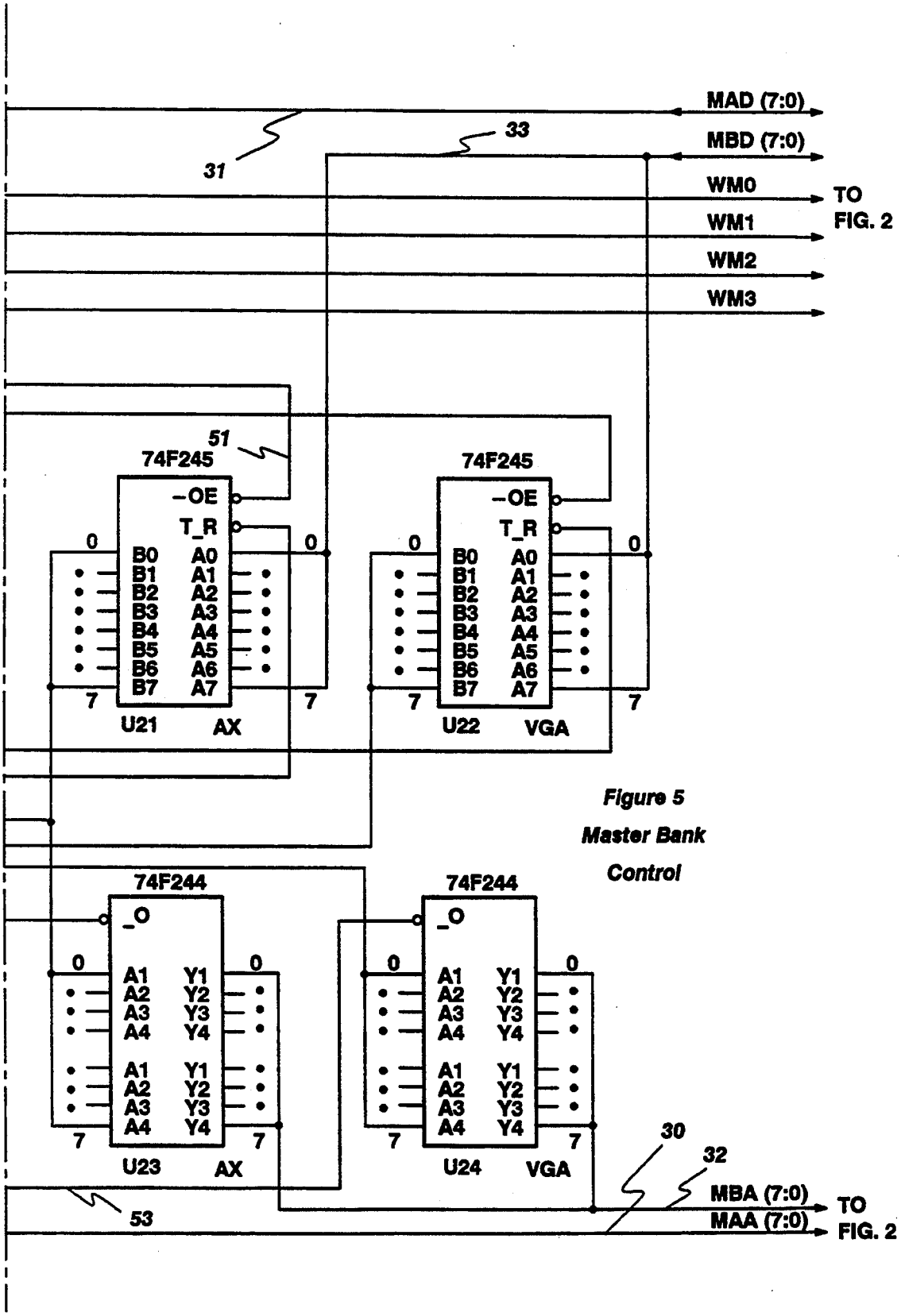
Figure 6B:
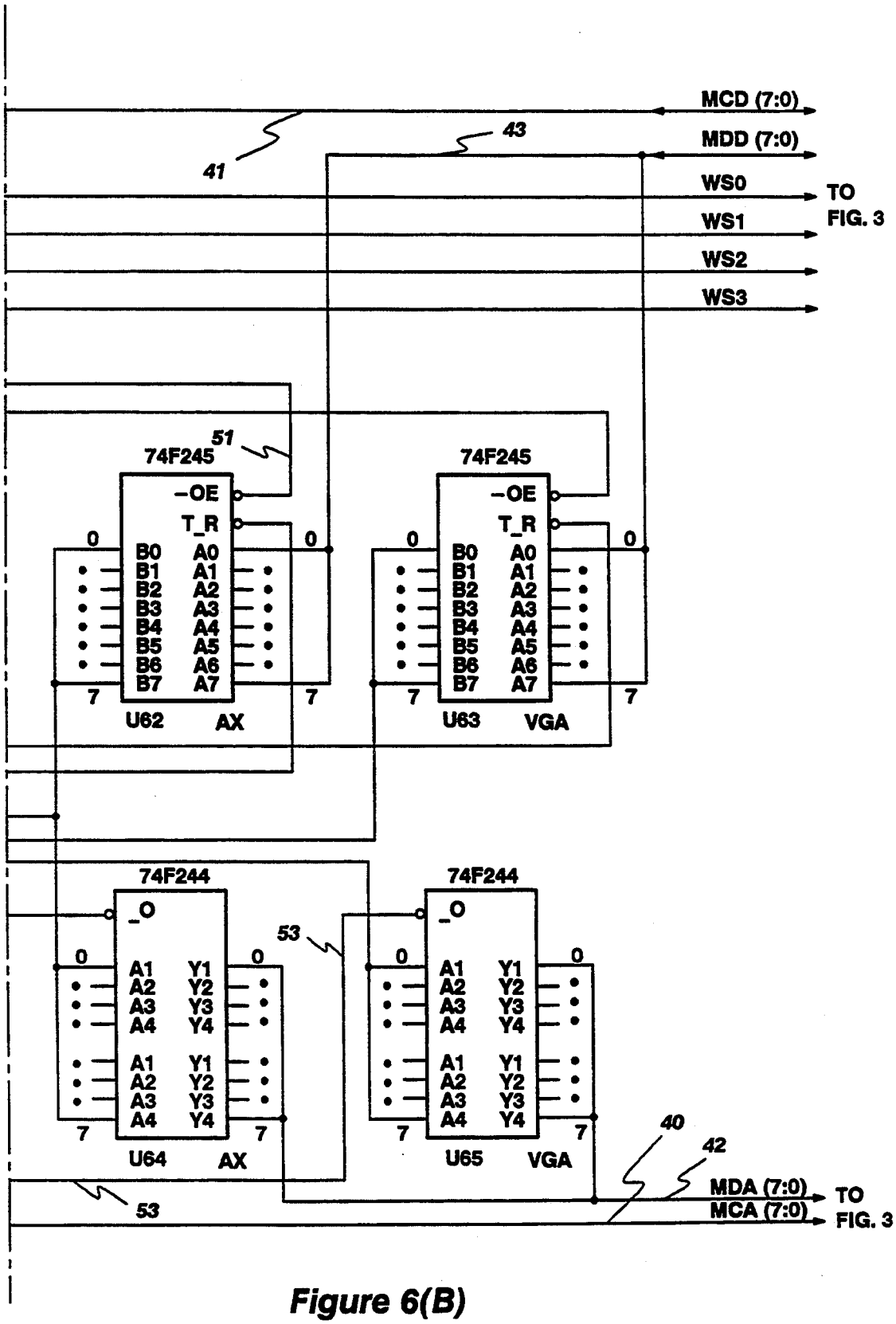

Referring to FIG. 4, circuitry is illustrated for interfacing control signals between the video controllers of FIG. 1 and the memory banks of FIGS. 2 and 3, as well as for generating further control signals utilized by the interface circuitry of FIGS. 5 and 6. A read/write control register 50 provides a mode enabling signal on a line 51 denoted as AXENAB. The AXENAB signal enables the system to operate in the AX video mode. The AXENAB signal is inverted by an inverting buffer 52 to form a VGAENAB mode enabling signal on a line 53. The VGAENAB signal enables the system to operate in the VGA video mode. The mode enabling signal is latched into the register 50 by user code from the computer system in which the video controllers are utilized. The user code selects either the VGA mode or the AX Japanese mode.

A multiplexer 54, using the AXENAB signal, selects between MRAS (Master Row Address Strobe), SRAS (Slave Row Address Strobe), VRAS10 (VGA Row Address Strobe for bytes 1 and 0) and VRAS32 (VGA Row Address Strobe for bytes 3 and 2) generating RASM02, RASM13 (Row Address Strobes for Master Memory Bank) and RASS02, RASS13 (Row Address Strobes for Slave Memory Bank). The bytes 0,2 and the bytes 1,3 are as illustrated in FIGS. 2 and 3.

When the AX mode is enabled, the multiplexer 54 switches the "10" inputs thereof to the corresponding "Y" outputs and when the VGA mode is enabled, the multiplexer switches the "11" inputs thereof to the corresponding "Y" outputs. Thus, when operating in the AX mode, the master RAS signal is applied to the RAS inputs of all of the memory chips of the master bank of FIG. 2 and the slave RAS signal is applied to the RAS inputs of all of the memory chips of the slave bank of FIG. 3.

On the other hand, when operating in the VGA mode, the VRAS10 signal provides the RAS strobe to all of the byte 0 and byte 2 chips of the memory banks of both FIGS. 2 and 3, and the VRAS32 signal provides the RAS strobe to the byte 1 and byte 3 chips of the memory banks of both FIGS. 2 and 3. Although in the prior art the VRAS10 signal strobes along a bank of memory in the byte 1,0 direction (illustrated in FIGS. 2 and 3), in the present invention VRAS10 strobes in the byte 0,2 direction orthogonal to the banks of memory. In a similar manner, the multiplexer 54 re-directs the VRAS32 signal to strobe orthogonal to the banks of memory. This is so that the RAS signals strobe in the same direction as the OE signals in accordance with VGA protocol in a manner to be further clarified.

In a manner similar to that described above with respect to the multiplexer 54, a multiplexer 55 generates the CAS signals for the master and slave banks of FIGS. 2 and 3 from the master, slave and VGA CAS signals from the controllers of FIG. 1. Unlike the RAS signals, however, when the multiplexer 55 selects the VGA mode in response to AXENAB, the VGA CAS signals VCAS10 and VCAS 32 are directed either to the master bank of FIG. 2 or the slave bank of FIG. 3 by a multiplexer 56 under control of the ninth VGA address bit VMA8. A pull up resistor 57 places a disabling signal on the non-selected outputs of the multiplexer 56. When VMA8 is low, the multiplexer 56 switches VCAS10 and VCAS32 to the YA and YB outputs thereof while applying the disabling signal to the YC and YD outputs. Conversely, when VMA8 is high, the multiplexer 56 switches VCAS10 and VCAS32 to the YC and YD outputs of the multiplexer 56 while applying the disabling signal to the YA and YB outputs. Thus, when the multiplexer 55 is operating in the VGA mode, VCAS10 and VCAS32 are directed either to the master bank of FIG. 2 or the slave bank of FIG. 3 in accordance with the state of VMA8 with the non-selected bank being disabled. The multiplexer 56, utilizing VMA8, determines whether a memory access is to the master 256 KB or the slave 256 KB of memory when operating in the VGA mode. By multiplexing the CAS signals in the manner described, the multiplexer 56 enables access to the two separate 256 KB memory banks based on the VGA memory address.

In a manner similar to that described above with respect to the multiplexer 54, a multiplexer 58, utilizing AXENAB, selects between the master, slave and VGA Output Enable signals to provide the Output Enable signals to the master and slave memory banks of FIGS. 2 and 3. When in the AX mode, the multiplexer 58 connects MOE02 to OEM02, MOE13 to OEM13, SOE02 to OES02 and SOE13 to OES13. In this manner, the Output Enable signals from the master EGA and slave EGA controllers are applied to the master bank and slave bank, respectively, in the manner expected by an EGA controller.

When operating in the VGA mode, however, the multiplexer 58 connects VOE10 to both OEM02 and OES02 while connecting VOE32 to both OEM13 and OES13. It is appreciated that in the manner described above with respect to the VGA RAS and CAS signals, the VGA OE signals are directed through the memory banks in the byte 0,2 and byte 1,3 direction rather than in the byte 1,0 and byte 3,2 direction as is normally done in the prior art. In this manner, the VGA RAS, CAS and OE signals are directed through the memory in the same direction in accordance with VGA video controller memory protocol. The multiplexers 54, 55 and 58 map the VGA RAS, CAS and OE signals from a direction normally parallel to the memory banks A–D into a direction orthogonal thereto.

The VMA8 signal from the VGA video controller 10 (FIG. 1) is gated through AND gates 59 and 60 by VGAENAB to form control signals designated as MOE and SOE. MOE denotes Master Output Enable and SOE denotes Slave Output Enable. When VMA8 is low, MOE is generated to enable data transfer with respect to the master bank of FIG. 2 in a manner to be described with respect to FIG. 5. When VMA8 is high, SOE is generated to enable data transfer with respect to the slave bank of FIG. 3 in a manner to be described with respect to FIG. 6. Thus, MOE and SOE are control signals generated from the ninth VGA memory address bit to select between the two 256 KB master and slave banks of memory.

The MOE and SOE signals are utilized in the interface circuitry of FIGS. 5 and 6 for enabling data transfer with respect to either the master bank or the slave bank. The circuitry of FIG. 4 also provides signals denoted as VDIR, SDIR and MDIR to the circuitry of FIGS. 5 and 6 for enabling data transfer direction. Thus, VDIR denotes VGA direction, SDIR denotes slave direction and MDIR denotes master direction. A direction signal is active when the associated controller (VGA, master EGA or slave EGA) is executing a memory read cycle. Thus, an AND gate 61 generates VDIR in response to VOE10 or VOE32. VDIR controls the direction of data flow through buffers when in read or write modes with respect to VGA memory access in a manner to be described with respect to FIGS. 5 and 6. The SDIR signal is generated by gates 62 in response to SOE02 or SOE13. The SDIR signal controls the direction of data flow through buffers when in the read or write modes with respect to slave EGA memory access in a manner to be described with respect to FIG. 6. Similarly, MDIR is generated by gates 63 in response to MOE02 or MOE13 to control the direction of data buffers in a manner to be described with respect to FIG. 5. It is appreciated that the gates 62 and the gates 63 perform the same logical function as the gate 61 and are equivalent thereto.

Referring now to FIG. 5, the control logic that interfaces the VGA controller 10 and the master EGA controller 11 of FIG. 1 with the master memory bank of FIG. 2 is illustrated. Control signals are provided to the interface of FIG. 5 from the circuitry of FIG. 4, as indicated by the legends. A multiplexer 70, in response to the AXENAB signal on the line 51, selects between the write enable signals MW0–MW3 from the master EGA controller 11 of FIG. 1 and the write enable signals VW0–VW3 from the VGA controller 10 of FIG. 1 to form the write enable signals WM0–WM3 for the individual bytes 0–3 of the master memory bank of FIG. 2.

It is appreciated that the connections of VW1 and VW2 to the input of the multiplexer 70 are reversed compared to the connections of MW1 and MW2 thereto. Whereas in the AX mode, MW1 and MW2 from the EGA video controller forms WM1 and WM2, respectively,—in the VGA mode, VW2 and VW1 from the VGA video controller form WM1 and WM2, respectively. This interchange of the VGA write enable signals is to maintain consistency with the orientation through the memory arrays of FIGS. 2 and 3 of the VGA RAS, CAS and OE signals by the circuitry of FIG. 4 to run orthogonal to the rows of memory chips, as discussed above. The circuitry of FIGS. 4–6 maps the VGA controller byte rows of 1,0 and 3,2 into memory byte columns of 0,2 and 1,3, respectively. This is to accommodate the EGA video controller orientation for the OE control lines of 0,2 and 1,3.

The circuitry of FIG. 5 includes gated transceiver buffers U5, U6, U21 and U22, as well as gated unidirectional buffers U7, U8, U23 and U24. Each gated transceiver buffer gates eight bits from one port thereof to the other port thereof in response to a signal applied to its OE enable input and in a direction in accordance with a signal applied to its TR direction input. Each gated unidirectional buffer transmits eight bits in one direction only in response to a signal applied to the G input thereof. The transceivers U5 and U21, and the buffers U7 and U23 are enabled during the AX modes of operation and the transceivers U6 and U22, and the buffers U8 and U24 are enabled during the VGA modes of operation. Transceivers U5 and U21, and buffers U7 and U23 are enabled by AXENAB. Transceivers U6 and U22 are enabled by the MOE signal described above with respect to FIG. 4, whereas the buffers U8 and U24 are enabled by VGAENAB. The direction of transmission through the transceivers U5 and U21 are controlled by the MDIR signal described above with respect to FIG. 4 and the direction of transmission through the transceivers U6 and U22 are controlled by the VDIR signal, also described above with respect to FIG. 4. The eight bit "A" ports of the transceivers U5 and U6 are connected in parallel to form the memory data bus 31 for bank A of FIG. 2, while the "A" ports of transceivers U21 and U22 are connected in parallel to form the memory data bus 33 for bank B of FIG. 2. In a similar manner, the outputs of buffers U7 and U8 form the memory address bus 30 for bank A of FIG. 2, while the outputs of buffers U23 and U24 form the memory address bus 32 for bank B of FIG. 2.

The multiplexed address and data bus 17 (bus A) from the master EGA video controller 11 is applied in parallel to the "B" port of transceiver U5 and to the input port of buffer U7. When the system is operating in the Japanese AX mode, the transceiver U5 is utilized for master bus A data accesses to the memory, whereas the buffer U7 is utilized to provide the master bus A address signals for the memory accesses. The MDIR signal applied to the transceiver U5 determines whether a memory access is a read or write operation and controls the direction of data flow through the transceiver U5. The RAS, CAS, OE and WE signals from the master EGA video controller 11 (FIG. 1)—selected and routed to the master memory bank of FIG. 2 through the circuitry of FIGS. 4 and 5, as described above,—appropriately time demultiplex the address and data signals on the master EGA bus 17 (bus A) as directed through the buffer U7 and the transceiver U5 along buses 30 and 31 to the address and data ports, respectively, of the bank A memory chips of FIG. 2.

In a manner similar to that described with respect to bus 17 (master bus A), bus 18 (master bus B) is routed to bank B of FIG. 2 through transceiver U21 and buffer U23. In the same manner as for bus A, MDIR provides directional control through the transceiver U21.

The sixteen bit wide memory data bus 13 from the VGA video controller 10 (FIG. 1) is divided through transceivers U6 and U22 to the eight-bit memory data buses 31 and 33 for banks A and B, respectively, of FIG. 2. The lower significant byte on bus lines (7:0) is directed through transceiver U6 to memory data bus 31. The higher significant byte on bus lines (15:8) is directed through transceiver U22 to memory data bus 33. The MOE signal enables the transceivers U6 and U22.

As discussed above, the MOE signal, in response to the ninth address bit VMA8 from the VGA video controller 10, selects the master bank of FIG. 2 when the VGA controller 10 is accessing a byte of memory located therein. The VDIR signal controls the direction of data flow through the transceivers U6 and U22 in accordance with whether a memory access is a read or write operation.

The memory address bus 14 from the VGA video controller 10 is directed through buffers U8 and U24 to memory address buses 30 and 32 to provide the VGA memory address to banks A and B of FIG. 2, respectively, for VGA memory accesses thereto.

It is appreciated from the foregoing that the memory bank A data bus 31 conveys data between memory bank A and either the master EGA controller bus A or the VGA controller data bus, and that the memory bank B data bus 33 conveys data between memory bank B and either the master EGA controller bus B or the VGA controller data bus. It is further appreciated that the memory bank A address bus 30 provides address signals to memory bank A from either the master EGA controller bus A or the VGA controller address bus, while the memory bank B address bus 32 provides address signals to memory bank B either from the master EGA controller bus B or the VGA controller address bus. Thus, in the AX mode, enabling U5, U7, U21 and U23 permits the addresses from bus A and bus B of the master EGA controller to be transmitted to bank A and bank B, respectively, of FIG. 2, and permits data to be transmitted therebetween. In the VGA mode, enabling U6, US, U22 and U24 permits addresses from the address bus of the VGA controller to be transmitted to both banks A and B of FIG. 2 and permits data transfer between the VGA data bus and banks A and B.

Because of the time delays introduced by the interposition of the transceivers U5, U6, U21 and U22 between the video controllers and the memory, the default direction of these transceivers is toward the memory so that memory writes can occur as quickly as possible. For memory reads, the direction is reversed by the appropriate active direction signal. This arrangement is utilized because more time is available during a memory read than during a memory write.

Referring to FIG. 6, circuitry for interfacing the VGA video controller 10 and the slave EGA video controller 12 of FIG. 1 to banks C and D of the slave bank of FIG. 3 is illustrated. The circuitry of FIG. 6 is structurally and functionally identical to that of FIG. 5 except that slave control signals and buses (denoted by the letter S) are input instead of master control signals and buses. Similarly, the output control signals and buses from FIG. 6 connect to the slave bank memory array of FIG. 3 (banks C and D) in identically the manner described above with respect to FIGS. 5 and 2. Thus, chips U41, U48–U51 and U62–U65 of FIG. 6 functionally parallel chips U31, U5–U8 and U21–U24 of FIG. 5, respectively.

The operation of the VGA video controller 10 in the VGA mode and the operation of the EGA controllers 11 and 12 in the AX mode are mutually exclusive with respect to each other. When the system is operating in the VGA mode, the address, data and control signals from the VGA controller are routed through the circuitry of FIGS. 4–6 to the video memory of FIGS. 2 and 3, and the address, data and control signals from the EGA controllers are effectively disconnected from the memory. When the system is operating in the AX mode, the address, data and control signals from the EGA controllers are routed to the memory, while the signals from the VGA controller are effectively disconnected.

Because of the novel interface provided by the circuitry of FIGS. 4–6 and the novel bus structures of FIGS. 2 and 3, the present invention utilizes one-half the number of expensive memory chips that would otherwise be required to provide the same functionality. Inexpensive TTL buffers, transceivers and multiplexers are utilized instead of duplicating expensive memory circuits. It is appreciated that the memory chips of FIGS. 2 and 3 are approximately ten times more expensive than the buffer, transceiver and multiplexer chips of FIGS. 4–6. The buffers, transceivers and multiplexers are standard commercially available chips. Therefore, no custom components are required to implement the present invention. The invention provides a video controller board that supports the diverse video controller memory architectures of the C+T 435 and the WDPVGA1B by providing an interface that shares common memory. Additionally, since two 435 EGA controllers are required to support Japanese AX video, the requisite memory can also support enhanced VGA modes at little additional cost utilizing the invention.

While the invention has been described in its preferred embodiment, it is to be understood that the words which have been used are words of description rather than limitation and that changes may be made within the purview of the appended claims without departing from the true scope and spirit of the invention in its broader aspects.

We claim:

1. Video controller apparatus comprising first video controller means of a first type for operating in accordance with a first video mode, normally with video memory dedicated thereto, and operative to provide address and control signals to, and to write data signals to and read data signals from its video memory in accordance with a first memory interface protocol, second video controller means of a second type for operating in accordance with a second video mode, normally with video memory dedicated thereto, and operative to provide address and control signals to, and to write data signals to and read data signals from its video memory in accordance with a second memory interface protocol, said first and second memory interface protocols being substantially different with respect to each other, a shared video memory utilized and shared by said first and second video controller means when operating in said first and second video modes, respectively, a source of mode enabling signal for selectively enabling said first or second video mode, and interface means coupling said first and second video controller means to said shared video memory and responsive to said mode enabling signal, said interface means being constructed and arranged to couple said address, data and control signals between said first video controller means and said shared video memory in accordance with said first memory interface protocol when said mode enabling signal is enabling said first video mode or to couple said address, data and control signals between said second video controller means and said shared video memory in accordance with said second memory interface protocol when said mode enabling signal is enabling said second video mode.

2. The apparatus of claim 1 wherein said interface means comprises first gated buffers responsive to said mode enabling signal for coupling said address and data signals between said first video controller means and said shared video memory in accordance with said first memory interface protocol when said mode enabling signal is enabling said first video mode, second gated buffers responsive to said mode enabling signal for coupling said address and data signals between said second video controller means and said shared video memory in accordance with said second memory interface protocol when said mode enabling signal is enabling said second video mode, and multiplexer means responsive to said mode enabling signal for selectively coupling either said control signals from said first video controller means to said shared video memory in accordance with said first memory interface protocol when said mode enabling signal is enabling said first video mode or said control signals from said second video controller means to said shared video memory in accordance with said second memory interface protocol when said mode enabling signal is enabling said second video mode.

3. The apparatus of claim 2 wherein said first gated buffers comprise first gated bi-directional data transceivers for coupling said data signals between said first video controller means and said shared video memory, and first gated address buffers for gating said address signals from said first video controller means to said shared video memory.

4. The apparatus of claim 3 wherein said second gated buffers comprise second gated bi-directional data transceivers for coupling said data signals between said second video controller means and said shared video memory, and second gated address buffers for coupling said address signals from said second video controller means to said shared video memory.

5. The apparatus of claim 4 further including first direction means coupled to said first video controller means for generating a first direction signal in accordance with whether said first video controller means is commanding a read or a write memory access, said first direction signal being coupled to said first gated bi-directional data transceivers for controlling data flow direction therethrough, and second direction means coupled to said second video controller means for generating a second direction signal in accordance with whether said second video controller means is commanding a read or a write memory access, said second direction signal being coupled to said second gated bi-directional data transceivers for controlling data flow direction therethrough.

6. The apparatus of claim 5 wherein said first and second gated bi-directional data transceivers are so arranged with respect to said first and second direction signals, respectively, that said first and second gated bi-directional data transceivers have a default data flow direction from said first and second video controller means toward said shared video memory, respectively.

7. The apparatus of claim 4 wherein said first video controller means comprises a VGA video controller providing a VGA data bus for conveying VGA memory data signals and providing a VGA address bus for conveying VGA memory address signals, and said second video controller means comprises at least one EGA video controller providing first and second EGA buses, each conveying time multiplexed memory address and data signals.

8. The apparatus of claim 7 wherein said shared video memory is comprised of at least first and second memory banks of memory chips, each said memory chip having an address port and a data port.

9. The apparatus of claim 8 wherein said interface means further comprises first and second memory data buses coupled to said data ports of said memory chips of said first and second memory banks, respectively, and first and second memory address buses coupled to said address ports of said memory chips of said first and second memory banks, respectively, said VGA data bus being coupled to said first and second memory data buses through said first gated bi-directional data transceivers, said VGA address bus being coupled to said first and second memory address buses through said first gated address buffers, said first EGA bus being coupled to said first memory data bus and said first memory address bus through one of said second gated bi-directional data transceivers and one of said second gated address buffers, respectively, said second EGA bus being coupled to said second memory data bus and said second memory address bus through another of said second gated bi-directional data transceivers and another of said second gated address buffers, respectively.

10. The apparatus of claim 9 wherein said VGA data bus is two bytes wide for carrying first and second bytes and said first and second memory data buses are each one byte wide, said first byte of said VGA data bus being coupled to said first memory data bus through one of said first gated bi-directional data transceivers and said second byte of said VGA data bus being coupled to said second memory data bus by another of said first gated bi-directional data transceivers.

11. The apparatus of claim 9 wherein each said memory chip comprises a Dynamic Random Access Memory (DRAM) chip with a Row Address Strobe (RAS) input, a Column Address Strobe (CAS) input, an Output Enable (OE) input and a Write Enable (WE) input, said DRAM chips in each said first and second memory banks being arranged in bytes.

12. The apparatus of claim 11 wherein said interface means further includes first and second groups of memory control lines, each said group including a RAS line, a CAS line and an OE line connected to corresponding RAS, CAS and 0E inputs of DRAM chips of corresponding bytes of said first and second memory banks, said first and second groups of memory control lines running transverse to said first and second memory banks and orthogonal to said first and second memory address and data buses, and a plurality of WE memory control lines corresponding to said bytes, respectively, each connected to said WE inputs of said DRAM chips comprising said byte corresponding thereto.

13. The apparatus of claim 12 wherein said VGA video controller provides first and second groups of VGA memory control signals, each said group of VGA memory control signals including a RAS signal, a CAS signal and an OE signal, and a plurality of VGA WE memory control signals.

14. The apparatus of claim 13 wherein said at least one EGA video controller provides an EGA RAS memory control signal, an EGA CAS memory control signal, first and second EGA OE memory control signals, and a plurality of EGA WE memory control signals.

15. The apparatus of claim 14 wherein said multiplexer means comprises first multiplexer means responsive to said mode enabling signal for coupling, when said mode enabling signal is enabling said VGA mode, said first and second groups of VGA memory control signals to said first and second groups of memory control lines, respectively, with said RAS, CAS and OE signals of said VGA memory control signals coupled respectively to said RAS, CAS and OE lines of said memory control lines—or for coupling, when said mode enabling signal is enabling said EGA mode, said EGA RAS memory control signal and said EGA CAS memory control signal to said RAS and CAS lines of said first and second groups of memory control lines, and said first and second EGA OE memory control signals to said OE lines of said first and second groups of memory control lines, respectively, thereby mapping said first and second groups of VGA memory control signals from a direction normally parallel to said memory banks to a direction orthogonal thereto, and second multiplexer means responsive to said mode enabling signal for selectively coupling either said plurality of VGA WE memory control signals or said plurality of EGA WE memory control signals to said plurality of WE memory control lines, respectively, when said mode enabling signal is enabling said VGA or said EGA mode, respectively, said VGA WE memory control signals being connected to said second multiplexer means in an order different from that of said EGA WE memory control signals to accommodate said orthogonal direction across said° memory banks.

16. The apparatus of claim 15 wherein said shared video memory comprises a master bank and a slave bank, said first and second memory banks comprising said master bank, and said VGA video controller provides a further address bit to distinguish between said master bank and said slave bank.

17. The apparatus of claim 16 wherein said interface means further includes logic means responsive to said further address bit from said VGA video controller and to said mode enabling signal to provide a Master Output Enable (MOE) signal and a Slave Output Enable (SOE) signal in accordance with said further address bit designating said master bank or slave bank, respectively, when said mode enabling signal is enabling said VGA mode.

18. The apparatus of claim 17 wherein said first gated buffers further comprise third gated bi-directional data transceivers for coupling said VGA memory data signals between said VGA video controller and said slave bank, and third gated address buffers for gating said VGA memory address signals from said VGA video controller to said slave bank, said first and third gated bi-directional data transceivers being enabled by said MOE and SOE signals, respectively.

19. The apparatus of claim 18 wherein said at least one EGA video controller comprises a master EGA video controller and said second video controller means includes a slave EGA video controller providing third and fourth EGA buses, each conveying time multiplexed memory address and data signals.

20. The apparatus of claim 19 wherein said second gated buffers further comprise fourth gated bi-directional data transceivers for coupling said data signals between said slave video controller and said slave bank, and fourth gated address buffers for coupling said address signals from said slave video controller to said slave bank.

21. The apparatus of claim 20 wherein said second direction means is coupled to said master video controller for generating said second direction signal in accordance with whether said master video controller is commanding a read or a write memory access, said apparatus further including third direction means coupled to said slave video controller for generating a third direction signal in accordance with whether said slave video controller is commanding a read or a write memory access, said third direction signal being coupled to said fourth gated bi-directional data transceivers for controlling data flow direction therethrough.

22. The apparatus of claim 21 wherein said slave bank of said shared video memory comprises third and fourth memory banks of memory chips, each said memory chip having an address port and a data port.

23. The apparatus of claim 22 wherein said interface means further includes third and fourth memory data buses coupled to said data ports of said memory chips of said third and fourth memory banks, respectively, and third and fourth memory address buses coupled to said address ports of said memory chips of said third and fourth memory banks, respectively, said VGA data bus being coupled to said third and fourth memory data buses through said third gated bi-directional data transceivers, said VGA address bus being coupled to said third and fourth memory address buses through said third gated address buffers, said third EGA bus being coupled to said third memory data bus and said third memory address bus through one of said fourth gated bi-directional data transceivers and one of said fourth gated address buffers, respectively, said fourth EGA bus being coupled to said fourth memory data bus and said fourth memory address bus through another of said fourth gated bi-directional data transceivers and another of said fourth gated address buffers, respectively.

24. The apparatus of claim 23 wherein said third and fourth memory data buses are each one byte wide, said first byte of said VGA data bus being coupled to said third memory data bus through one of said third gated bi-directional data transceivers and said second byte of said VGA data bus being coupled to said fourth memory data bus by another of said third gated bi-directional data transceivers.

25. The apparatus of claim 23 wherein each said memory chip comprises a Dynamic Random Access Memory (DRAM) chip with a Row Address Strobe (RAS) input, a Column Address Strobe (CAS) input, an Output Enable (OE) input and a Write Enable (WE) input, said DRAM chips in each said third and fourth memory banks being arranged in bytes.

26. The apparatus of claim 25 wherein said interface means further includes third and fourth groups of memory control lines, each said group including a RAS line, a CAS line and an OE line connected to corresponding RAS, CAS and OE inputs of DRAM chips of corresponding bytes of said third and fourth memory banks, said third and fourth groups of memory control lines running transverse to said third and fourth memory banks and orthogonal to said third and fourth memory address and data buses, and a plurality of slave WE memory control lines corresponding to said bytes, respectively, each connected to said WE inputs of said DRAM chips comprising said byte corresponding thereto.

27. The apparatus of claim 26 wherein said slave EGA video controller provides a slave EGA RAS memory control signal, a slave EGA CAS memory control signal, first and second slave EGA OE memory control signals, and a plurality of slave EGA WE memory control signals.

28. The apparatus of claim 27 wherein said first multiplexer means is operative to couple, when said mode enabling signal is enabling said VGA mode, said first and second groups of VGA memory control signals to said third and fourth groups of memory control lines, respectively, with said RAS, CAS and OE signals of said VGA memory control signals coupled respectively to said RAS, CAS and OE lines of said memory control lines—or to couple, when said mode enabling signal is enabling said EGA mode, said slave EGA RAS memory control signal and said slave EGA CAS memory control signal to said RAS and CAS lines of said third and fourth groups of memory control lines, and said first and second slave EGA OE memory control signals to said OE lines of said third and fourth groups of memory control lines, respectively, thereby mapping said first and second groups of VGA memory control signals from a direction normally parallel to said memory banks to a direction orthogonal thereto, said second multiplexer means is operative to selectively couple either said plurality of VGA WE memory control signals or said plurality of slave EGA WE memory control signals to said plurality of WE memory control lines, respectively, when said mode enabling signal is enabling said VGA or said EGA mode, respectively, said VGA WE memory control signals being connected to said second multiplexer means in an order different from that of said slave EGA WE memory control signals to accommodate said orthogonal direction across said memory banks.

29. The apparatus of claim 28 wherein said first multiplexer means further includes switching means responsive to said further address bit for directing said CAS signals of said first and second groups of VGA memory control signals either to said CAS lines of said first and second groups of memory control lines or to said CAS lines of said third and fourth groups of memory control lines in accordance with said further address bit.

30. The apparatus of claim 1 wherein said first video controller means requires a first video memory size and said second video controller means requires a second video memory size, said shared video memory being no larger than said first or second video memory size.

* * * * *